US006699368B2

(12) United States Patent
Ishii et al.

(10) Patent No.: US 6,699,368 B2
(45) Date of Patent: Mar. 2, 2004

(54) SHOE PRESS BELT AND MANUFACTURING METHOD

(75) Inventors: Hirofumi Ishii, Tokyo (JP); Nobuyuki Ito, Tokyo (JP); Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 76 days.

(21) Appl. No.: 10/034,453

(22) Filed: Dec. 27, 2001

(65) Prior Publication Data

US 2002/0092639 A1 Jul. 18, 2002

(30) Foreign Application Priority Data

Jan. 17, 2001 (JP) ..... 2001-009576

(51) Int. Cl.[7] ..... D21F 3/02; D21F 7/08

(52) U.S. Cl. ..... 162/358.4; 162/901; 428/167; 428/351

(58) Field of Search ..... 162/109, 117, 162/306, 206, 207, 348, 358.1, 358.2, 358.3, 358.4, 358.5, 360.3, 357.1, 361, 362, 900–904; 139/383 A, 383 AA, 425 A; 428/163, 167, 168, 183–186, 908.8, 909, 351; 442/79–94, 98, 99, 118–119, 164

(56) References Cited

U.S. PATENT DOCUMENTS 4,162,190 A * 7/1979 Ashworth ..... 162/358.2
4,559,258 A * 12/1985 Kiuchi ..... 428/156
4,643,916 A * 2/1987 Kiuchi ..... 427/176
6,136,151 A * 10/2000 Davenport et al. ..... 162/306
6,383,339 B1 * 5/2002 Gstrein ..... 162/358.4
6,465,074 B1 * 10/2002 FitzPatrick et al. ..... 428/131
2002/0060052 A1 * 5/2002 Best ..... 162/358.4

FOREIGN PATENT DOCUMENTS

DE 196 51 557 A1 * 6/1998 ..... B30B/9/24
JP 59-54598 4/1984
JP 63-159591 * 7/1988 ..... D21F/3/08

OTHER PUBLICATIONS

Christiansen, J., "Adhesion", May 22, 2000, taken from http://www.iprod.auc.dk/forsk/poly/www/lim/index.htm.*

"Surface Energies of Polymers", taken from http://www.sa-breen.com/surface_energies_of _polymers.html.*

* cited by examiner

*Primary Examiner*—Steven P. Griffin
*Assistant Examiner*—Eric Hug
(74) *Attorney, Agent, or Firm*—Howson and Howson

(57) ABSTRACT

To improve the water squeezing function of a shoe press belt for papermaking, the wet web side layer of a main body of the belt is composed of a high molecular weight elastic material, and the wet web facing surface of the wet web side layer is made hydrophobic. Water, squeezed from the wet web under compression in a shoe press, and transferred to the surface of the wet web side layer of the belt through a felt, may be shaken off reliably before the belt is again subjected to compression.

11 Claims, 9 Drawing Sheets

FIG.12

| Examples | Surface 3a | Water holding section | | Water shaking off test 1 | Water squeezing test 2 |
|---|---|---|---|---|---|
| | | Side wall 4a | Bottom surface 4b | | |
| Example 1 | Hydrophobic fluororesin $\theta$=75° | Without groove | Without groove | 3 | 3 |
| Example 2 | Hydrophobic fluororesin $\theta$=90° | Without groove | Without groove | 5 | 3 |
| Example 3 | Hydrophobic fluororesin $\theta$=90° | Hydrophobic fluororesin $\theta$=90° | Hydrophobic fluororesin $\theta$=90° | 5 | 5 |
| Example 4 | Hydrophilic urethane resin $\theta$=30° | Hydrophobic fluororesin $\theta$=90° | Hydrophobic fluororesin $\theta$=90° | 4 | 5 |
| Example 5 | Hydrophilic urethane resin $\theta$=30° | Hydrophobic silicone resin $\theta$=75° | Hydrophobic silicone resin $\theta$=75° | 3 | 4 |
| Example 6 | Hydrophilic urethane resin $\theta$=30° | Hydrophobic silicone resin $\theta$=75° | Hydrophilic urethane resin $\theta$=30° | 3 | 3 |
| Example 7 | Hydrophilic urethane resin $\theta$=30° | Hydrophobic fluororesin $\theta$=90° | Hydrophilic fluororesin $\theta$=30° | 4 | 4 |
| Comp. Example 1 | Hydrophilic urethane resin $\theta$=30° | Without groove | Without groove | 1 | 1 |
| Comp. Example 2 | Hydrophilic urethane resin $\theta$=30° | Hydrophilic urethane resin $\theta$=30° | Hydrophilic urethane resin $\theta$=30° | 1 | 2 |

$\theta$=contact angle

SHOE PRESS BELT AND MANUFACTURING METHOD

FIELD OF INVENTION

This invention relates generally to papermaking and more particularly to a shoe press belt, for use in a papermaking machine, having a superior water draining effect, and to a method of manufacturing the belt.

BACKGROUND OF THE INVENTION

Shoe press devices adopted for use in the press stage of a papermaking process in recent years may be roughly divided into two types. One is shown in FIG. 8, and another is shown in FIG. 9. In both of these shoe press devices, a shoe 62 is in opposed relationship with a roll 61, with upper and lower endless felts 63 and 64 provided between the shoe and the roll, and a wet web P therebetween. A press belt 65 is arranged between the lower felt 64 and the shoe 62 so that the press belt 65 runs along with the lower felt 64. The shoe 62 raises the press belt 65, thereby pressing the felts 63 and 64 against the roll 61. Thus, a relatively wide nip area is formed and water squeezing is effected by the pressure between the roll 61 and the shoe 62.

The press belt 65 of FIG. 8 is a comparatively long belt, spanning a plurality of rolls 66, there being four such rolls in the particular shoe press device depicted in FIG. 8. The press belt 65 is adapted to run under tension. On the other hand, the press belt 65 of FIG. 9 is a comparatively short belt.

As shown in FIG. 10(*a*), the press belt 65, used for the two types of shoe press, is generally composed of a base member 65*a* sandwiched by a wet web side layer 65*b* and a shoe side layer 65*c*, both of which layers are composed of high molecular weight elastic members. The surface of the high molecular weight elastic member 65*b* is either a flat surface H as shown in FIG. 10(*a*), or has a grooved water-holding section M as shown in FIG. 10(*b*).

The press belt 65, having a flat surface H as shown in FIG. 10(*a*), may be completed at low cost, since only grinding the wet web side is necessary in the manufacturing process. The low manufacturing cost is the reason why this type of press belt is still in wide use. On the other hand, in the use of the press belt 65 of FIG. 10(*b*), having a water-holding section M, the water squeezed from the wet web P (FIGS. 8 and 9) by the pressure applied by the roll 61 and the shoe 62, is retained within the water holding section M, so that the water squeezing efficiency of the belt of FIG. 10(*b*) is far greater than that of the belt of FIG. 10(*a*). Unexamined Japanese Utility Model Publication No. 54598/1984 is representative of the belt having a water-holding section. In this case, a material having a hydrophilic property, such as polyurethane resin, is used as a high molecular weight elastic material.

Notwithstanding the improved water squeezing efficiency afforded by the press belt of FIG. 10(*b*), the amount of moisture which remains in the belt has increased as result of the use of increased nip pressures and greater operating speeds in recent years, and this moisture retention has been an obstacle to water squeezing efficiency improvement. That is, when the nip pressure of the roll 61 and shoe 62 is increased, more water is squeezed from the wet web, but the result is that more water is held on the flat surface H (FIG. 10(*a*)) or the water holding section M (FIG. 10(*b*)) of the press belt 65. Therefore, in some cases, because of the strong affinity of the press belt surface for moisture, resulting from hydrogen bonding, when the press belt is made hydrophilic as taught in Unexamined Japanese Utility Model Publication No. 54598/1984, water may not be shaken off adequately from the press belt 65 in the tangential direction.

Under the nip pressure in such a situation, because of the moisture saturation in the felts 63 and 64, and in the press belt 65, it has not been possible to drain water effectively from the wet web. The tendency of the belt to retain water has become more significant with the recent demand for higher speed operation in papermaking machinery. The underlying reason for the greater water retention at higher operating speeds is that the more rapid movement of the press belt 65 results in the shortening of the time interval between the successive compressions of given parts of the press belt 65 by the roll 61 and the shoe 62. Consequently, the time available for water to be shaken off a given area of the press belt 65 between compression cycles inevitably becomes shorter. This has become a particularly acute problem in the operation of the shoe press device of FIG. 9. Excessive water retention was not only a problem in the case of a press belt 65 having a water holding grooved section M, but was also encountered as a problem in the case of a press belt 65 having a flat surface H.

An object of this invention is to provide a belt for a shoe press, which is capable of solving the above-mentioned problems, thereby improving the water-squeezing function. Another object of the invention is to provide a novel method for the manufacture of such a belt.

SUMMARY OF THE INVENTION

To achieve the above-mentioned objectives, the shoe press belt in accordance with the invention is a shoe press belt in which a wet web side layer of a main body of the belt comprises a high molecular weight elastic material, characterized in that the surface of the wet web side layer is hydrophobic. Consequently, water squeezed from the wet web under compression in the shoe press device, and shifting to the surface of the wet web side layer of the main body of the belt through the felt, may be shaken off reliably before the belt is again subjected to compression.

If the main body of the belt also comprises a water holding section on the surface of the wet web side layer, both the surface of the wet web side layer and at least a part of the water holding section are preferably hydrophobic. Thus, the moisture which is squeezed from the wet web under compression in a shoe press device, passed through the felt, and held on the surface of the wet web side layer of the main body of the belt, and in the water holding section, may be shaken off reliably before the belt is again is subjected to compression.

In another embodiment of the invention in which a water holding section is provided on the surface of the wet web side layer of the belt, the surface of the wet web side layer may be hydrophilic, but at least a part of the inner surface of the water holding section is hydrophobic. In this case, moisture which is squeezed from the wet web under compression in the shoe press device, passed through the felt, and held on the surface of the wet web side layer of the main body of the belt, may be shaken off reliably by virtue of the hydrophobic property of the water holding section before the belt is again subjected to compression.

Preferably, the hydrophobic property is such that the contact angle between a drop of water and a reference plane corresponding to the surface of the belt is at least 50°, thereby enhancing the effect of the hydrophobic property of the surface of the wet web side layer, or of the water holding section, in promoting shaking of moisture off the belt.

The belt is preferably manufactured by forming a wet web side layer of a main body of the belt with a high molecular weight elastic material having a hydrophobic property, and forming a hydrophobic surface by grinding the surface of the wet web side layer. Thus, a surface having a hydrophobic property may be easily produced on the wet web side layer of the main body of the belt.

The method of manufacture may optionally include a third step, in which a water holding section is formed on the surface of the wet web side layer. Thus, both the surface of the wet web side layer of the main body of the belt and the inner surface of the water holding section, can be easily made hydrophobic.

In an alternative method, a wet web side layer of the main body of the belt is formed of a high molecular weight, hydrophobic elastic material, a film comprising a high molecular weight elastic material of hydrophilic property is formed on the surface of the wet web side layer, and a water holding section is formed, extending inward from the film. In this manner, it is easy to make only the inner surface of the water holding section hydrophobic.

In accordance with still another alternative method, a wet web side layer of the main body of the belt is formed of a high molecular weight, hydrophilic elastic material, a water holding section is formed on the surface of the wet web side layer, and a film comprising a high molecular weight, hydrophobic, elastic material is formed on an inner surface of the water holding section. In this manner, it is easy to make only the inner surface of the water holding section hydrophobic.

BRIEF DESCRIPTION OF THE DRAWINGS

FIG. 1(*b*) shows a belt in which a water holding section is provided on the surface of the wet web side layer;

FIG. 4(*b*) is a schematic view of a manufacturing apparatus for making a relatively short belt in accordance with the invention;

FIG. 5(*b*) is an enlarged section depicting a manufacturing process in accordance with the invention, in which a hydrophilic surface film is formed;

FIG. 5(*c*) is an enlarged section depicting a manufacturing process in accordance with the invention, in which a hydrophobic water holding section is formed, but in which the outer surface of the belt is hydrophilic;

FIG. 6(*b*) is an enlarged section depicting a manufacturing process in accordance with the invention, in which a hydrophobic film is formed;

FIG. 6(*c*) is an enlarged section depicting a manufacturing process in accordance with the invention, in which a hydrophobic film of the wet web side layer has been removed except within the water holding section;

FIG. 7(*b*) is an enlarged sections depicting a manufacturing process in accordance with the invention, in which a hydrophobic surface layer is formed by filling the water holding section with a hydrophobic filler;

FIG. 7(*c*) is an enlarged sections depicting a manufacturing process in accordance with the invention, in which a hydrophobic film of the wet web side layer has been removed except within the water holding section;

FIG. 7(*d*) is an enlarged sections depicting a manufacturing process in accordance with the invention, in which grooves are cut in the water holding section leaving a part of a filler in the water holding section;

FIG. 12 is a table of test results.

DETAILED DESCRIPTION OF THE PREFERRED EMBODIMENT

Embodiments of the invention will now be explained with reference to FIGS. 1(*a*) through 7(*d*).

Figure 1A:
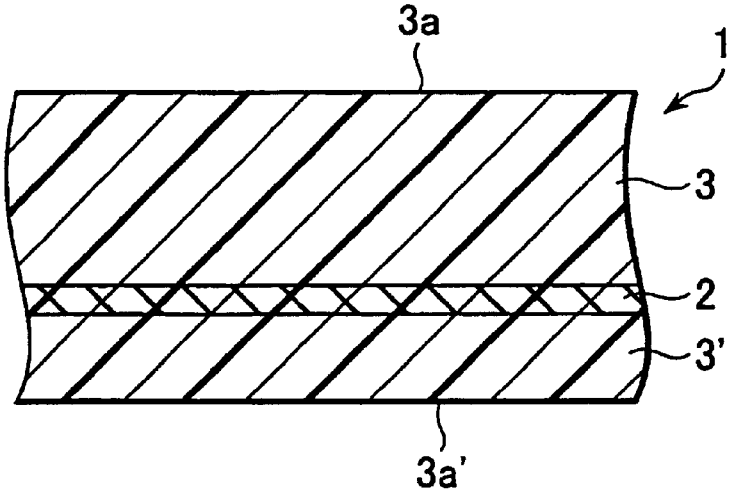
FIG. 1(*a*) is an enlarged section of a part of the main body of a belt in accordance with the invention wherein the surface of which is flat.
Figure 1B:
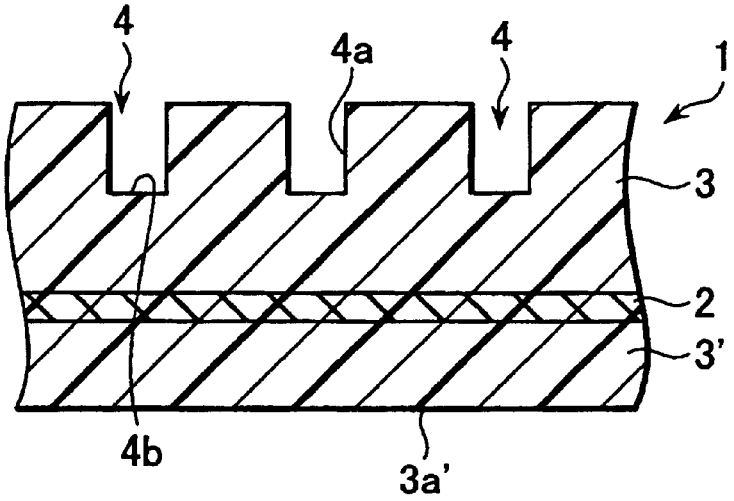

In FIGS. 1(*a*) and 1(*b*), the numeral 1 denotes the main body of a belt, composed of a base member 2 sandwiched between a wet web side layer 3 and a shoe side layer 3', each of which consists of a high molecular weight elastic material. FIG. 1(*a*) represents a case in which the surface 3*a* of the wet web side layer 3 is flat, and FIG. 1(*b*) illustrates a case in which a water holding section 4 is formed on the surface of the wet web side layer 3. In each case, the shoe side surface 3*a'* of the shoe side layer 3' is flat.

The wet web side layer 3 and the shoe side layer 3', both of which comprise a high molecular elastic material may be formed on the base member 2 either in separate steps, or in a single operation. Although the expression "layer" is used in this specification for convenience, it is not necessary that the layers have distinct compositions; it is sufficient that a high molecular weight elastic member is formed on each side of the base member 2. Although not shown in the drawings, the high molecular weight elastic material penetrates the base member 2, and hardens or cures.

The base member 2 imparts the necessary strength to the main body 1 of belt. The base member may be in the form of a woven fabric having a warp and weft, or a non-woven fabric composed of overlapping warp and weft yarns. Also, the base member may comprise a spirally arranged, belt-shaped, non-woven or woven fabric. In short, any and all base member constructions and compositions may be used in the belt in accordance with the invention.

The water holding section 4 shown in FIG. 1(*b*) is formed by continuous concavities or grooves extending in the running direction of the main body 1 of the belt. But, this construction is only an example of many possible alternative constructions of the water holding section. For example, so long as water can be held therein, blind holes (not shown) may be utilized.

The water holding section 4 comprises side walls 4*a* and a bottom surface 4*b*. The side walls 4*a* and the bottom surface 4*b* are straight and form a groove having a rectangular cross-section in the embodiment illustrated in FIG. 1(*b*). However, other configurations can be adopted so long as they function to hold water. For example, the side walls and bottom surface may be curved, or configured to provide a dovetail groove having a narrow entrance and a wide interior.

The entire flat area of the surface 3*a* of the wet web side layer 3 as shown in FIG. 1(*a*) is hydrophobic, so as to weaken the affinity of surface 3*a* for water. Further, as shown in FIG. 1(*b*), where a water holding section 4 is formed on the surface of the wet web side layer 3, both the outer surface and the inner surfaces of the water holding section 4 are made hydrophobic. Alternatively, the outer surface may be made hydrophilic and all or a part of the inner surfaces of the water holding section 4 may be made hydrophobic.

Figure 2:
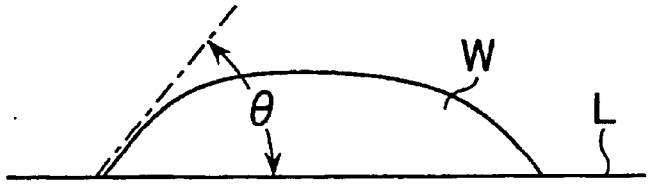
FIG. 2 is an enlarged section showing a drop of water on a belt surface, illustrating the contact angle where the belt surface is hydrophobic.

The term "hydrophobic" as used herein refers to the power of a surface of the high molecular weight material to expel water held thereon, whether it be water held on the outer surface of the wet web side layer 3 or on the inner surfaces of the water holding section 4. As shown in FIG. 2, the magnitude of the hydrophobic property of a surface is determined by the contact angle θ between a drop of water W and a reference plane L tangent to the surface on which the drop of water is placed at the point of contact. A larger contact angle θ, corresponds to a greater hydrophobic property. It is desirable that the hydrophobic property of the outer surface of the wet web side layer 3, or the inner surfaces of the water the holding section 4, correspond to a contact angle θ of 50° or more. Experiments have confirmed that the best results are obtained where the contact angle θ is at least 90°. To meet the requirement for a contact angle of 50° or more, fluorocarbon resins, silicone resins, and the like are preferably utilized as the high molecular weight elastic material. However, a hydrophobic property can also be imparted to a high molecular weight elastic material by mixing fluorine oil, silicone oil, fluorine powder, or silicone powder with the material while the material is still in a liquid or glue-like state, before it hardens in the curing stage.

The wet web side layer 3 itself may be composed of a high molecular weight, hydrophilic elastic member and, in order for the outer surface of the wet web side layer 3 to be made hydrophobic, a hydrophobic film of high molecular weight elastic material may be formed on the outer surface. The high molecular weight, hydrophilic elastic material may be selected from among rubber and other elastomers, but preferably, polyurethane resin should be used. Thermosetting urethane resin is preferred from the standpoint of desirable physical properties for use in a shoe press belt.

In cases where materials of hydrophobic and hydrophilic properties are used as the high molecular weight elastic material in the main body 1 of the belt, it is preferable that the hardness of the material upon curing be in the range of 70–98° (JIS-A).

The function of the main body 1 of the belt will now be explained with reference to FIG. 3. The majority of the moisture squeezed out of the wet web P is transferred to the felts 63 and 64 in the nip N by the roll 61 and the shoe 62 of the shoe press device. Moisture is also transferred to the outer surface of the wet web side layer 3 of the main body 1 of the belt.

Figure 3:
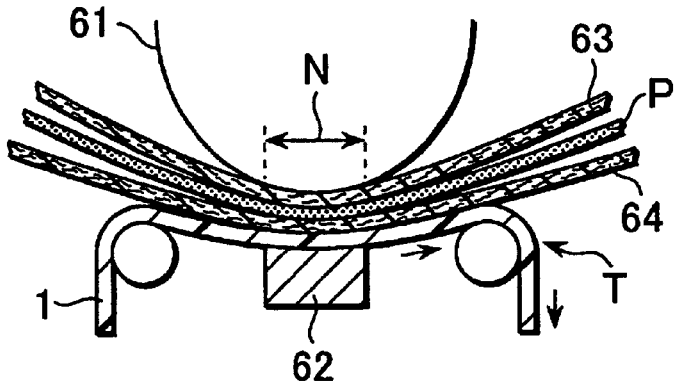
FIG. 3 is a sectional view of a shoe press section of a papermaking machine, showing the main body of the belt of this invention between a roll and a shoe of a shoe press device.

When the belt is released from the nip pressure and continues to move in the direction of the arrow in FIG. 3, its direction of movement is changed through a large angle as it passes over the roll at location T. If the outer surface of the wet web side layer 3 is flat, and all areas of the outer surface are hydrophobic, the moisture which has been transferred to the outer surface of the wet web side layer 3 may be easily shaken off at location T.

Further, if a water holding section 4 is formed on the outer surface of the wet web side layer 3, the moisture which is squeezed out of the wet web at the nip N, and held on the outer surface of the wet web side layer 3, and in the water holding section 4 of the main body 1 of the belt, will also be shaken off easily at location T, when the outer surface of the belt and the inner surfaces of its water holding section 4 are hydrophobic.

In the case in which the outer surface of the wet web side layer 3 is hydrophilic, and the water holding section 4 is hydrophobic, the moisture squeezed from the wet web at the nip N, and held in the water holding section 4, will be shaken off and at location T. The moisture remaining on the hydrophilic outer surface of the wet web side layer be removed essentially in the same manner and to the same extent as it would be removed in the case of a conventional belt.

Thus, when the outer surface of the wet web side layer 3 or the water holding section 4 is hydrophobic, the moisture carried by the belt at these areas will be more efficiently expelled in tangential direction, with a resulting improved dehydration effect. As a result of the high degree of water removal from the main body 1 of the belt at location T, achieved by virtue of the hydrophobic outer surface or the hydrophobic water holding section, the water carried by the part of the belt approaching the nip is substantially reduced, and consequently more moisture can be squeezed from the wet web.

In the case of a belt having a hydrophobic water holding section 4 but a hydrophilic outer surface, the dehydrating effect is improved over that of a conventional belt. But, the effect may be inferior to that of a belt whose outer surface is also hydrophobic. However, even if the outer surface of the wet web side 3 is hydrophilic, if at least a part of the inner surfaces of the water holding section 4 is hydrophobic, it is possible to demonstrate a superior dehydrating effect compared to that of a conventional belt. The amount of expensive high molecular weight, hydrophobic elastic material can be reduced, thereby reducing the material cost. In short, the composition of the belt may be modified depending on the how much dehydrating effect is required.

Methods of manufacturing the main body 1 of the belt in accordance with the invention will now be explained.

Figure 4A:
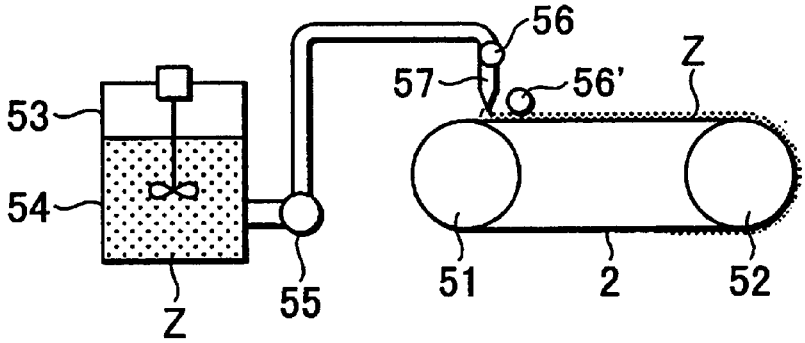
FIG. 4(*a*) is a schematic view of a manufacturing apparatus for making a relatively long belt in accordance with the invention.
Figure 4B:
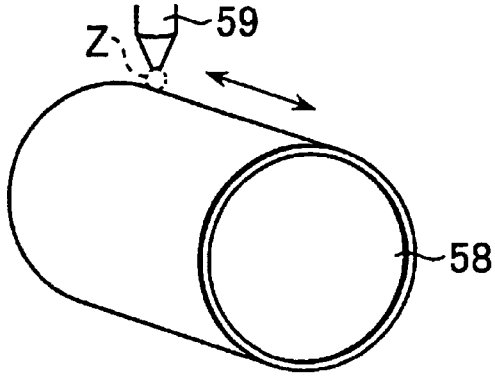

As shown in FIG. 4(*a*), an endless base member 2 is arranged to span, and run on a pair of rolls 51 and 52. A high molecular weight elastic material Z is supplied through a nozzle 57 and spread on the base member 2. The high molecular weight, hydrophobic, elastic material Z is fed from a tank 53 equipped with a stirring device 54, which agitates the material in the tank, and a pump 55, which supplies the material to the nozzle 56 through a duct. A traversing device 56 moves the nozzle 57 in the lateral direction and a rolling device 56' spreads the material Z on the member 2.

After a predetermined amount of the high molecular weight elastic material Z has been spread on, and impregnated into, the base member 2, plural layers are accumulated while the base member 2 continues to run. When the layers reaches a prescribed thickness, the material is heated and cured by a heating apparatus (not shown). At this point, the shoe side layer 3' in FIGS. 1(*a*) and 1(*b*) has been formed from the high molecular weight elastic material Z.

Then, when the high molecular weight elastic member Z which eventually forms the shoe side layer 3' reaches a prescribed hardness, the combined base 2 and shoe side layer 3' are detached from the rolls 51 and 52, and turned inside out. Then, with the already accumulated high molecular weight elastic material on the inside, a predetermined tension is given to the partially formed belt spanning the rolls 51 and 52, and the belt is again is caused to run while a high molecular weight elastic material Z is similarly applied on the reverse side of the base member 2 by nozzle 57. When the material reaches a prescribed thickness on the reverse side, it is cured by heat to form the completed web side layer 3 as in FIGS. 1(*a*) and 1(*b*).

Thereafter, the main body 1 of the belt is completed by forming a flat outer surface 3*a* as in FIG. 1(*a*) by grinding the wet web side layer 3, or by forming a flat outer surface and thereafter cutting the water holding section 4 into the flat surface thus formed.

Figure 9:
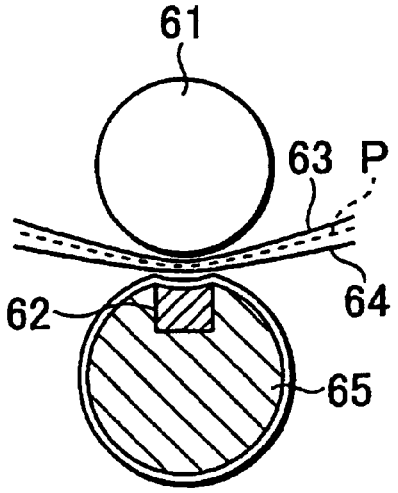
FIG. 9 is a schematic view of a shoe press section of a papermaking machine, in which a relatively short belt is used.
Figure 10A:
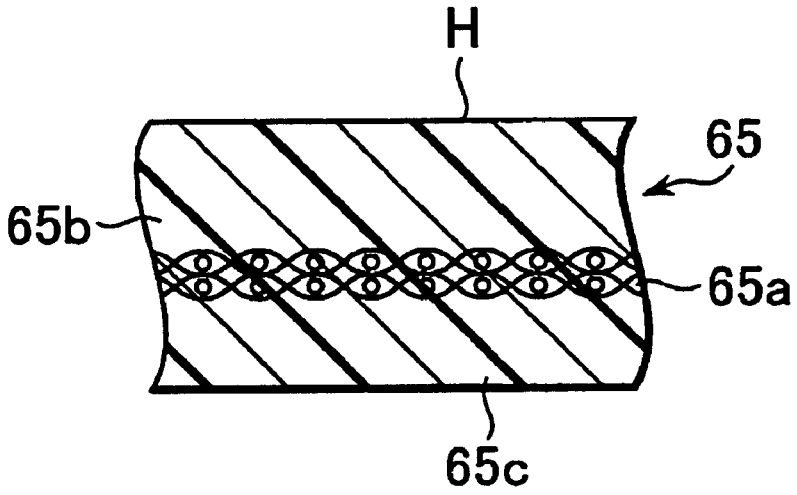
FIG. 10(*a*) is an enlarged section of a shoe press belt in which the surface of the wet web side layer is flat FIG. 10(*b*) is an enlarged section of a shoe press belt in which a water holding section is provided on the surface of the wet web side layer.
Figure 10B:
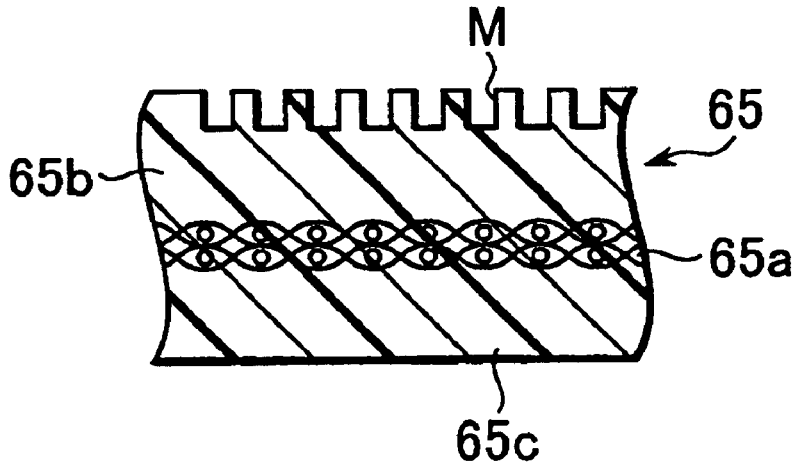

As shown in FIG. 4(*b*), it possible to utilize the cylindrical surface of a single roll 58 to manufacture a belt. A shoe side layer 3' is first formed by a high molecular weight elastic material on the surface of roll 58 surface. Next, a base member 2 is arranged thereon. Then, a high molecular weight elastic material is applied to the base member by a nozzle 59 to produce the main body 1 of belt. This method of manufacture is effective to produce the main body of a belt of relatively short type for a shoe press device as shown in FIG. 9.

Although the methods describe above are preferred, the main body 1 of the belt in accordance with the invention can be made by various other methods. Even with the apparatus shown in FIG. 4(*a*), it is possible to form the wet web side layer 3 and the shoe side layer 3 at the same time by impregnating the high molecular weight elastic material from one side of the base member 2, without first forming a layer of high molecular weight elastic material on one side of the base member 2, turning the resulting combination inside-out, and thereafter forming another layer of high molecular weight elastic material on the opposite side. Likewise with the apparatus shown in FIG. 4(*b*), it is possible to form the wet web side layer 3 and the shoe side layer 3' simultaneously by impregnating the high molecular weight elastic material from one side of the base member 2.

Methods to make the surface 3*a* of the wet web side layer 3 hydrophilic, and the entire or parts of the inner surfaces of the water holding section 4 hydrophobic, will be described.

Figure 5A:
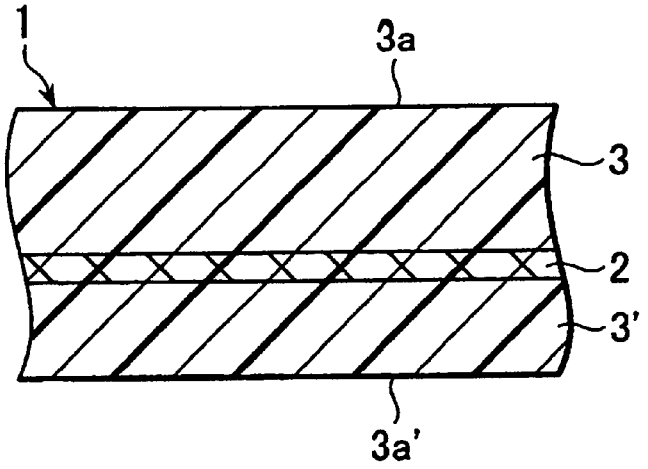
FIG. 5(*a*) is an enlarged section depicting a manufacturing process in accordance with the invention, in which a hydrophobic wet web side layer is formed.
Figure 5B:
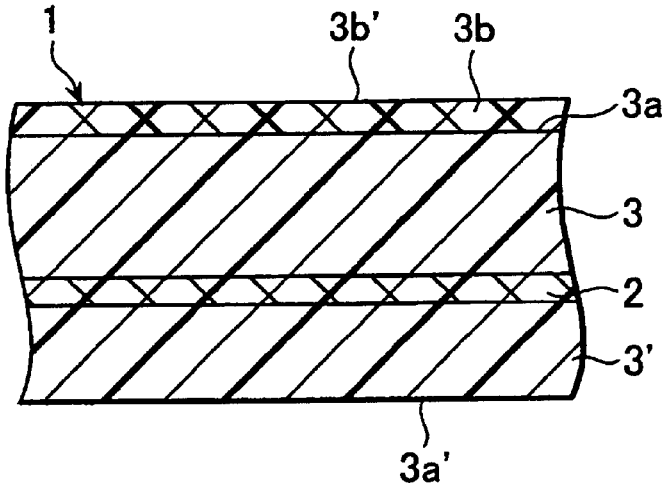
Figure 5C:
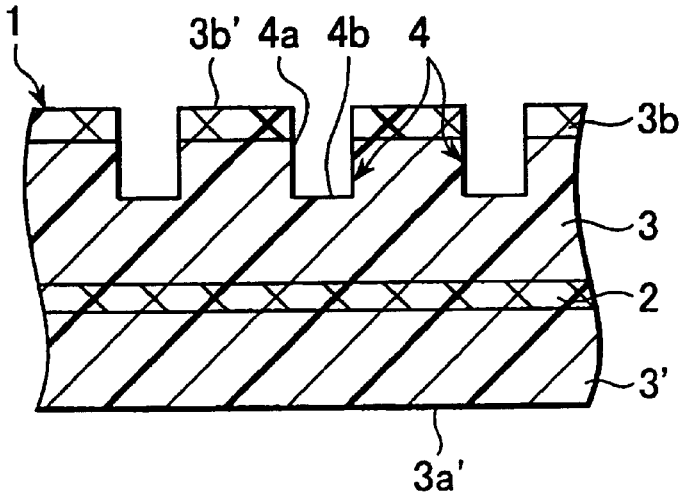

A first method is shown in FIGS. 5(*a*)–5(*c*). As shown in FIG. 5(*a*), the wet web side layer 3 and the shoe side layer 3', sandwiching a base member 2, are formed with a high molecular weight, hydrophobic elastic material. Thereafter, flat surfaces 3*a* and 3*a*' are formed by grinding. In this case, the shoe side layer 3' may be composed of a hydrophilic high molecular weight elastic material instead of a hydrophobic one. Next, as shown in FIG. 5(*b*), a film 3*b*, of high molecular weight, hydrophilic elastic material, is formed on the surface 3*a*. Then, as depicted in FIG. 5(*c*), a water holding section 4 is cut into the wet web side layer 3, the water holding section having a depth sufficient to extend through the film and into the wet web side layer 3. According to this method, since the outer surface 3*b*' of the wet web side layer 3 is the outer surface of the film 3*b*, the outer surface 3*b*' is hydrophilic while the bottom surface 4*b* of the water holding section 4 and its side walls 4*a* (excluding the thickness corresponding to that of the film 3*b*) are hydrophobic.

Figure 6A:
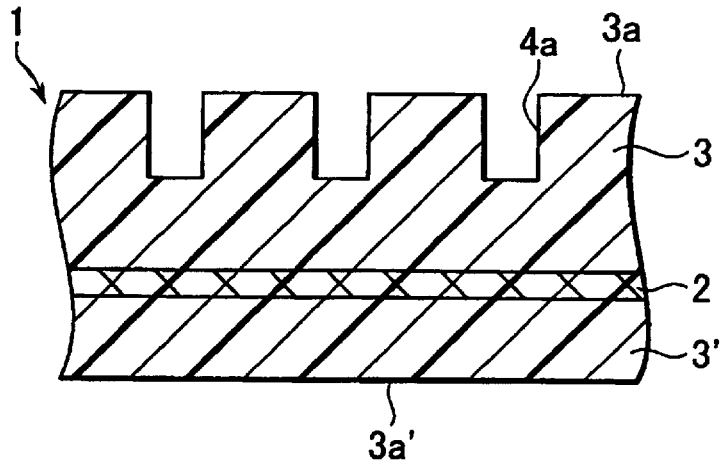
FIG. 6(*a*) is an enlarged section depicting a manufacturing process in accordance with the invention, in which a hydrophilic wet web side layer having a water holding section is formed.
Figure 6B:
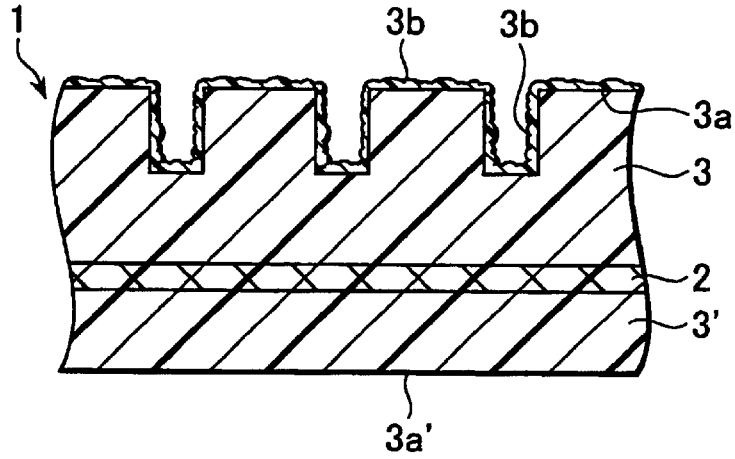
Figure 6C:
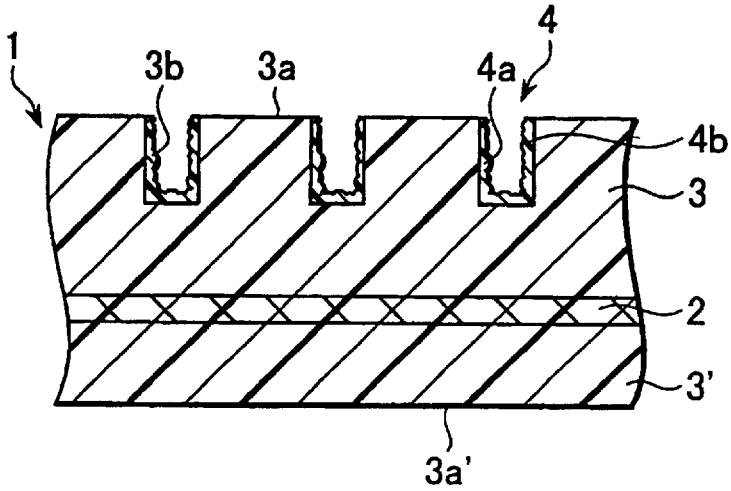
Figure 7A:
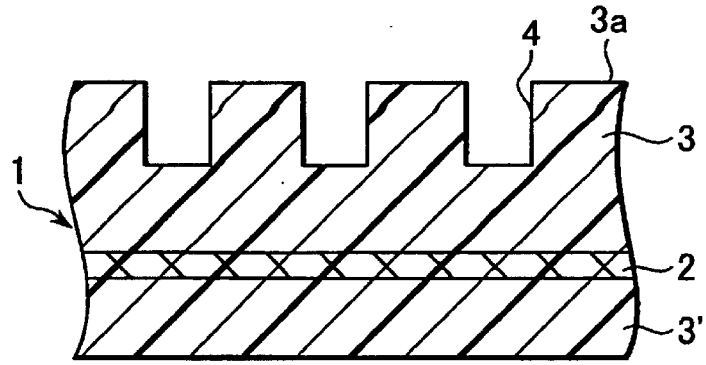
FIG. 7(*a*) is an enlarged sections depicting a manufacturing process in accordance with the invention, in which a hydrophilic wet web side layer having a water holding section is formed.
Figure 7B:
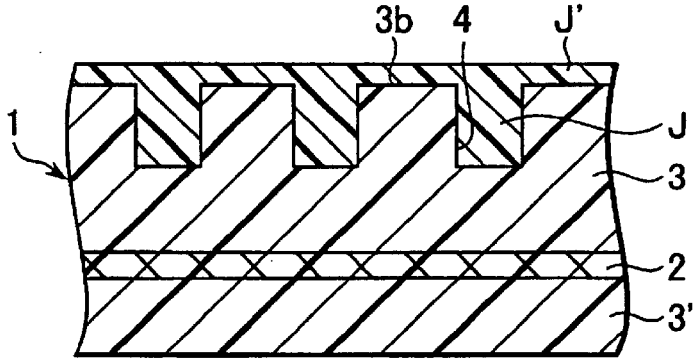
Figure 7C:
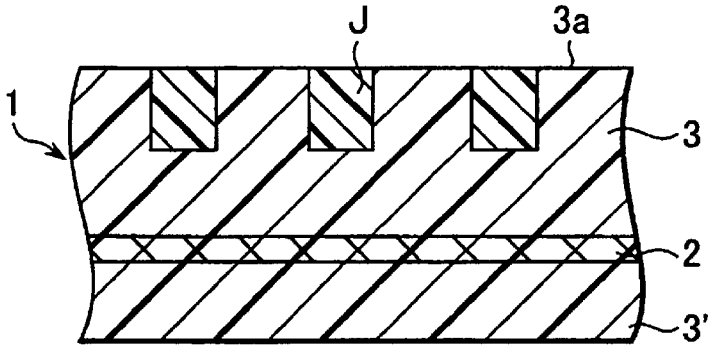
Figure 7D:
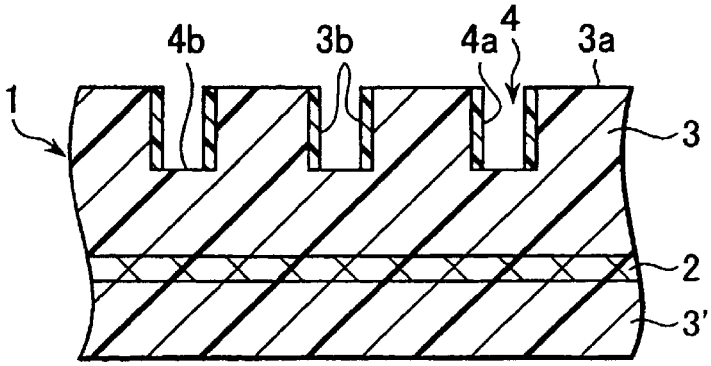
Figure 8:
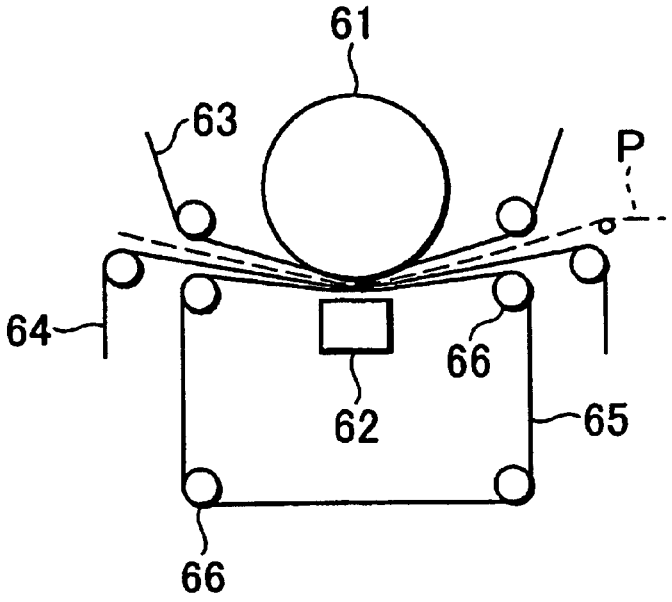
FIG. 8 is a schematic view of a shoe press section of a papermaking machine, in which a relatively long shoe press belt is used.

A second method is depicted in FIGS. 6(*a*)–6(*c*). First, as shown in FIG. 6(*a*) the wet web side layer 3 and the shoe side layer 3', sandwiching the base member 2, are formed from a high molecular weight, hydrophilic elastic material. Thereafter, smooth surfaces 3*a* and 3*a*' are formed by grinding, and the water holding section 4 is formed on the surface 3*a* of the web side layer 3. Next, utilizing an applicator, such as, a sprayer (not shown), a film layer 3*b* comprising a hydrophobic high molecular weight elastic material is applied to the flat surface 3*a*, and to the side walls 4*a* and the bottom surface 4*b* of the water holding section 4 as shown in FIG. 6(*b*). The hydrophobic film layer 3*b* is then cured. In this case, it is important that every corner of the water holding section 4 receive the spread film layer material. In the case illustrated in FIG. 6(*b*), the film 3*b* is formed even on the surface 3*a* of the wet web side layer 3. This is simply because it is easier to coat the entire exposed surface of the layer 3 than to coat only the interior of the water holding section 4. As illustrated in FIG. 6(*c*), the film 3*b* covering the surface 3*a* is be removed by grinding. Thus, the surface 3*a* of the wet web side layer 3 of the main body 1 of the belt is made hydrophilic, while the side walls 4*a* and the bottom surface 4*b* of the water holding section 4 are covered by the hydrophobic film 3*b*.

A third method is shown in FIGS. 7(*a*)–7(*d*). As shown in FIG. 7(*a*), the wet web side layer 3 and the shoe side layer 3', sandwiching the base member 2, are formed from a high molecular weight, hydrophilic elastic material. Then, smooth surfaces 3*a* and 3*a*' are formed by grinding. Thereafter, the water holding section 4 is cut into the surface 3*a* of the wet web side layer 3. The width of the grooves cut into the surface 31 to form the water holding section 4 is wider than the desired final width produced width by the twice thickness of the film layers to be formed later on opposite walls of the grooves. Next, an applicator, such as a nozzle (not shown), is used to fill the grooves of the water-holding section with a high molecular weight, hydrophobic elastic material J, as shown in FIG. 7(*b*). Because it would be difficult to fill only the grooves, the material is also allowed to accumulate on the surface 3*a* of the wet web side layer 3 as a covering J'. When the material J within the water holding section 4, and the covering J' on the surface 3*a*, are cured, the covering J' on the surface 3*a* is removed, as shown in FIG. 7(*c*), to expose the surface 3*a*, which comprises a hydrophilic, high molecular weight elastic material. Then, a part of the filler J is cut out, as shown in FIG. 7(*d*), by a cutter (not shown) to leave the filler J on the side walls 4*a* of the water holding section 4 in the form of the film 3*b*. Thus, the surface 3*a* of the wet web side layer 3 of the main body 1 of the belt is made hydrophilic and the side walls 4*a* of the water holding section 4 are made hydrophobic. It is also possible to leave the film 3*b* of the filler J on the bottom surface 4*b* as well as on the side walls 4*a* depending upon the depth of operation of the cutting tool.

Concrete examples 1–7 and comparative examples 1–2 will now be explained with reference to FIG. 12. These examples and comparative examples have in common the fact that, in each example, a wet web side layer and a shoe side layer comprising a high molecular weight elastic material were formed respectively on the opposite sides of a base member. Moreover, the main body of the belt was composed so that the shoe side layer was inside, and the wet web side layer was outside, in an endless loop having with a diameter of 0.5 m. In case of belts having a water holding section, the water holding section was in the form of a helical groove, with the height of the side walls of the groove being 1 mm and the width of the bottom being 0.8 mm. The adjacent turns of the helical groove were disposed at intervals of 2.5 mm. Thirty water holding sections were provided every 10 cm in the CMD direction.

EXAMPLE 1

Surface 3*a* of wet web side layer: fluoro, high molecular weight, hydrophobic elastic material (contact angle=75° with a drop of water) No water holding section 4.

EXAMPLE 2

Surface 3*a* of wet web side layer: fluoro, high molecular weight, hydrophobic elastic material (contact angle=90° with a drop of water). No water holding section 4.

EXAMPLE 3

Surface 3*a* of wet web side layer: fluoro, high molecular weight, hydrophobic elastic material (contact angle=90° with a drop of water). Side 4*a* of water holding section 4: fluoro, high molecular weight, hydrophobic elastic material (contact angle=90° with a drop of water). Bottom 4*b* of water holding section 4: fluoro, high molecular weight, hydrophobic elastic material (contact angle=90° with a drop of water)

EXAMPLE 4

Surface 3*a* of wet web side layer: urethane high molecular weight, hydrophilic elastic material (contact angle=30° with a drop of water). Side 4*a* of water holding section 4: fluoro, high molecular weight, hydrophobic elastic material (contact angle=90° with a drop of water). Bottom 4*b* of water holding section 4: fluoro, high molecular weight, hydrophobic elastic material (contact angle=90° with a drop of water).

EXAMPLE 5

Surface 3*a* of wet web side layer: urethane high molecular weight, hydrophilic elastic material (contact angle=30° with a drop of water). Side 4*a* of water holding section 4: silicone high molecular weight, hydrophobic elastic material (contact angle=75° with a drop of water). Bottom 4*b* of water holding section 4: silicone high molecular weight, hydrophobic elastic material (contact angle=75° with a drop of water)

EXAMPLE 6

Surface 3*a* of wet web side layer: urethane high molecular weight, hydrophilic elastic material (contact angle=30° with a drop of water) Side 4*a* of water holding section 4: silicone high molecular weight, hydrophobic elastic material (contact angle=75° with a drop of water) Bottom 4*b* of water holding section 4: urethane high molecular weight, hydrophilic elastic material (contact angle=30° with a drop of water)

EXAMPLE 7

Surface 3*a* of wet web side layer: urethane high molecular weight, hydrophilic elastic material (contact angle=30° with a drop of water). Side 4*a* of water holding section 4: fluoro, high molecular weight, hydrophobic elastic material (contact angle=90° with a drop of water). Bottom 4*b* of water holding section 4: urethane high molecular weight, hydrophilic elastic material (contact angle=30° with a drop of water)

Comparative Example 1

Surface 3*a* of wet web side layer: urethane high molecular weight, hydrophilic elastic material (contact angle=30° with a drop of water). No water holding section 4.

Comparative Example 2

Surface 3*a* of wet web side layer: urethane high molecular weight, hydrophilic elastic material (contact angle=30° with a drop of water). Side 4*a* of water holding section 4: urethane high molecular weight, hydrophilic elastic material (contact angle=30° with a drop of water). Bottom 4*b* of water holding section 4: urethane high molecular weight, hydrophilic elastic material (contact angle=30° with a drop of water)

Under the conditions of the above-mentioned examples 1–7 and the comparative examples 1–2, the following tests 1 and 2 were conducted.

Figure 11A:
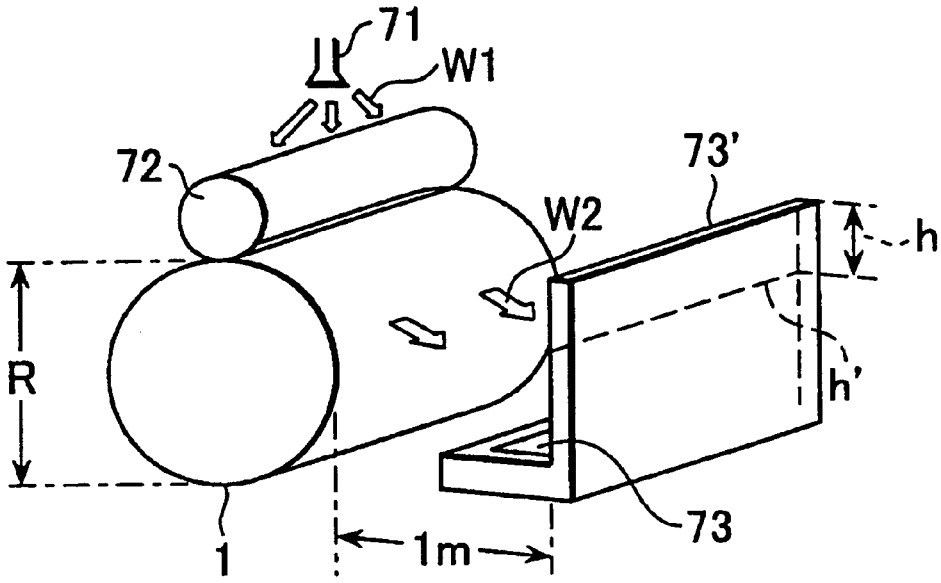
FIG. 11(*a*) is a perspective view of a testing apparatus for testing the ability of a shoe press belt to shake off water FIG. 11(*b*) is a sectional view of a device to test the water squeezing function of a wet web.
Figure 11B:
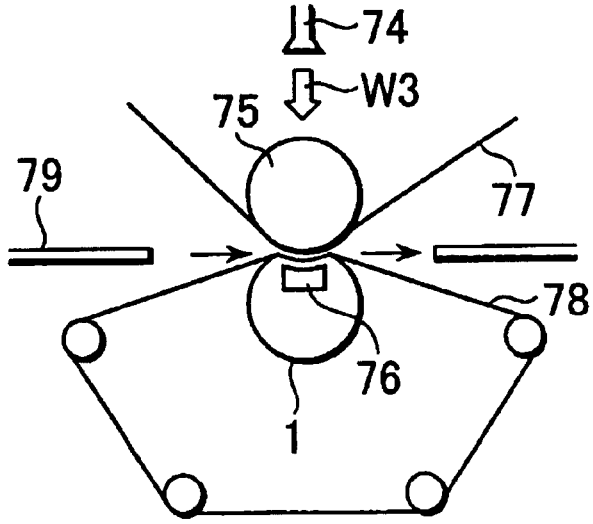

The device shown in FIG. 11(*a*) was used for the test 1 of the water shaking-off function. A water current W1 was first projected from the nozzle 71 set up above a top roll 72 which touched the main body 1 of the 0.5 m diameter belt. The pressure was 3 kg/cm$^2$ and the flow rate was 15 liters/minute. At this time, the top roll 72 was covered by a water film resulting from the flow W1. The water then flowed to the main body 1 of the belt, being rotated in the direction of arrow at the speed of 1000 m/minute through the top roll 72. Then, the flow was shaken off, becoming a water current W2, which flew tangentially forward of the main body 1 of the belt. The water current W2 hit the screen 73', set up one meter in front of the main body 1 of the belt, at position h', and accumulated in a water receiving measuring trough 73. The magnitude of the hydrophobic property of the main body 1 of the belt can be measured by observing the distance h from the upper edge of the screen 73'. If the above-mentioned distance h is short, water is shaken off from the belt in a comparatively short time, and if the distance h is large, the main body 1 of the belt retains water for a relatively long time.

The following evaluations were made based on the above-mentioned measurement distance h and the results are tabulated in FIG. 12. A greater figure in the column headed "Water shaking off test 1" indicates a superior water shaking off performance. If the measurement distance h was less than ⅕×diameter R of the belt, it was evaluated as 5. If the measurement distance h was less than ¼×diameter R of the belt but greater than ⅕×diameter R of the belt, it was evaluated as 4. If the measurement distance h was less than ½×diameter R of the belt but greater than ¼×diameter R of the belt, it was evaluated as 3. If the measurement distance is less than ⅔×diameter R of the belt but greater than ½×diameter R of the belt, it was evaluated as 2. If the measurement distance h was greater than ⅔×diameter R of the belt, the evaluation was 1.

The device shown in FIG. 11(*b*) was used in the test 2, for ascertaining the water squeezing function of each belt. In this test device, the main body 1 of the belt was arranged at a position opposed to the press roll 75, and the press shoe 76 was arranged so that the main body 1 of the belt could be pressed from inside against the press roll 75. Between the press roll 75 and the main body 1 of the belt, there were arranged a top felt 77 and a bottom felt 78, both of which comprised a short fiber of 11 dtex nylon 6 integrated with a ground fabric by needle punching so that its areal weight became 1500 g/m$^2$. The main body 1 of the belt ran in the travelling speed of 1000 m/minute under a nip pressure of 1000 kN/m between the press roll 75 and the press shoe 76. A water current W3 was projected as a jet from a nozzle 74, set up above the press roll 75, at a pressure of 3 kg/cm$^2$ and a flow rate of 15 liters/minute. At this time, the top roll 75 was covered by a water film from the current W3, and the water current W3 was also supplied to, and absorbed in, the top felt 77 and the bottom felt 78. Ultimately, the water reached the main body 1 of the belt. Under these conditions a wet web 79 having a 70% moisture content was placed on the bottom felt 78 and caused to pass through the nip. After the passage, the remaining moisture in the wet web 79 was measured, and the measurement results were recorded.

The following evaluations, shown in FIG. 12 are based on the above-mentioned measurement results. The greater number under in the column headed "Water squeezing test 2" corresponds to a better water squeezing performance. If the remaining moisture was less than 45%, the evaluation was 5. If the remaining moisture was 45% or more, but less than 50%, the evaluation was 4. If the remaining moisture is 50% or more, but less than 53%, the evaluation was 3. If the remaining moisture is 53% or more, but less than 55%, the evaluation was 2. If the remaining moisture is 55% or more, the evaluation was 1. The above-mentioned method of measuring the wet web moisture is based on a method of examining moisture in paper and hardboard provided by JIS P8147.

From FIG. 12, it can be confirmed that the test 1 results demonstrate that those belts whose wet web facing surfaces had a hydrophobic property of greater magnitude had superior water shaking off properties. Moreover, it can be observed from the results of test 2 that those belts having wet web facing surfaces with hydrophobic properties of greater magnitude also exhibited a superior water squeezing function. The tests also confirm that, those belts having a water holding section 4 exhibit a superior effect water squeezing effect. The test results also confirm that those belts having hydrophobic properties of greater magnitude in their water holding sections 4, or whose water holding sections have a greater proportion of hydrophobic surface area, exhibit superior water squeezing effects.

The advantages of the invention may be summarized as follows.

The shoe press belt in accordance with the invention is a shoe press belt in which the wet web side layer of a main body of the belt comprises a high molecular weight elastic material characterized in that the surface of the wet web side layer is hydrophobic. Consequently, water, squeezed from the wet web under compression in the shoe press and transferred to the wet web facing surface of the wet web side layer of the main body of the belt through the felt, may be reliably shaken off before the belt is again subjected to compression. Therefore, even with the recent trend toward increased nip pressures and higher operating speeds, the amount of the moisture which remains on the surface of the wet web side layer of the main body of the belt decreases before the belt is subjected to pressurization again. Thus, the water squeezing efficiency of the belt is greatly improved.

If a water holding section is provided on the wet web side layer, and the wet web facing surface of the wet web side layer and at least a part of the water holding section are hydrophobic, the moisture which is squeezed from the wet web under compression in the shoe press, and held on the surface of the wet web side layer of the belt, and in the water holding section, may be reliably shaken off before the belt is again subjected to compression. Here again, the water squeezing efficiency is greatly improved.

Even where the web facing surface of the wet web side layer is hydrophilic, if at least a part of the inner surface of the water holding section is hydrophobic, moisture will be reliably shaken off the belt from the water holding section, and good water squeezing efficiency can be achieved.

When the contact angle between a drop of water and the belt surface is 50° or more, the hydrophobic property of the surface is such that the shaking of moisture off the belt will be ensured.

A hydrophobic surface may be easily produced on the wet web side layer of the main body of the belt by a manufacturing method in which the wet web side layer is formed from a high molecular weight, hydrophobic elastic material, and a hydrophobic surface is formed by grinding the surface of the wet web side layer.

A belt having a hydrophobic outer surface and also a hydrophobic water holding section can be easily made by forming a wet web side layer from a high molecular weight, hydrophobic elastic material, forming a hydrophobic surface by grinding the surface of the wet web side layer, and forming a water holding section on the surface of the wet web side layer. In this case, both the surfaces of the wet web side layer and the surfaces of the water holding section can be easily made hydrophobic.

A belt having a hydrophilic outer surface, but a hydrophobic water holding section can be readily made by forming a wet web side layer from a high molecular weight, hydrophobic elastic material, forming a film on the surface of the wet web side layer from a high-molecular weight, hydrophilic elastic material, and forming a water holding section extending through the film, and into the wet web side layer. In this case, the inner surface of the water holding section can be advantageously made hydrophobic in a simple manner in the process of cutting the water holding section.

Finally, a shoe press belt may be manufactured by first forming a wet web side layer of a main body of the belt from a high molecular weight, hydrophilic elastic material, forming a water holding section on the surface of the wet web side layer, and forming a film comprising a high molecular weight elastic material of hydrophobic property on an inner surface of the water holding section. In this way the inner surface of the water holding section can easily be made hydrophobic while the outer surface of the wet web side layer can be hydrophilic.

What is claimed is:

1. A shoe press belt for receiving water from a wet web through a felt in a nip area comprising a press roll and a shoe, where the felt and the wet web placed thereon are compressed, the belt having a main body with a wet web side layer capable of contacting a felt, the wet web-side layer being composed of a single, hydrophobic, high molecular weight, elastic material, the wet web side layer having a wet web facing surface, and the wet web side layer having a water holding section formed in its wet web facing surface.

2. A shoe press belt according to claim 1, in which the magnitude of the hydrophobic property of the wet web facing surface is such that the contact angle between the edge of a drop of water and the wet web facing surface is at least 50°.

3. A shoe press belt having a main body with a wet web side layer comprising a high molecular weight elastic material, the wet web side layer having a wet web facing surface, in which the wet web side layer has a water holding section formed in its wet web facing surface, the water holding section having interior surfaces, in which the wet web facing surface of said wet web side layer is hydrophilic, and in which at least a part of the interior surfaces of said water holding section are hydrophobic.

4. A shoe press belt according to claim 3, in which the magnitude of the hydrophobic property of each said hydrophobic part of the interior surfaces of said water holding section is such that the contact angle between the edge of a drop of water and each said hydrophobic part of the interior surfaces of said water holding section is at least 50°.

5. A method of manufacturing a shoe press belt for receiving water from a wet web through a felt in a nip area comprising a press roll and a shoe, where the felt and the wet web placed thereon are compressed, comprising, as a first step, the formation of a wet web side layer of a main body of a belt from a single high molecular weight, hydrophobic, elastic material, said wet web side layer being capable of contacting a felt, and, as a second step, the formation of a water holding section on a wet web facing surface of the wet web side layer.

6. A method of manufacturing a shoe press belt comprising, as a first step, the formation of a wet web side layer of a main body of a belt from a high molecular weight, hydrophobic, elastic material, the wet web side layer having a wet web facing surface, as a second step, the formation of a film on said wet web facing surface, the film comprising a high molecular weight hydrophilic elastic material of hydrophilic property, and, as a third step, the formation of a water holding section extending through said film and into said wet web side layer.

7. A method of manufacturing a shoe press belt for receiving water from a wet web through a felt in a nip area comprising a press roll and a shoe where the felt and the wet web placed thereon are compressed, comprising, as a first step, the formation of a wet web side layer of a main body of a belt from a high molecular weight, hydrophilic, elastic material, the wet web side layer having a wet web facing surface, as a second step, the formation of a water holding section extending from said wet web facing surface into the wet web side layer, and, as a third step, the formation of a film, comprising a high molecular weight, hydrophobic elastic material, on an inner surface of said water holding section while maintaining the wet web facing surface of said wet web side layer as a hydrophilic surface.

8. In a papermaking machine, a shoe press comprising a press roll, a shoe, a felt having a wet web placed thereon, and a shoe press belt, portions of the wet web, felt and shoe press belt being compressed between the press roll and the shoe, with the felt being disposed between the wet web and the shoe press belt, wherein said shoe press belt has a main body with a wet web side layer contacting said felt, the wet web side layer being composed of a single, hydrophobic, high molecular weight, elastic material, the wet web side layer having a wet web facing surface and a water holding section formed in said wet web facing surface.

9. A shoe press according to claim 8, in which the magnitude of the hydrophobic property of the wet web facing surface is such that the contact angle between the edge of a drop of water and the wet web facing surface is at least 50°.

10. In a shoe press of a papermaking machine, shoe press belt having a main body with a wet web side layer comprising a high molecular weight elastic material, the wet web side layer having a wet web facing surface, in which the wet web side layer has a water holding section formed in its wet web facing surface, the water holding section having interior surfaces, in which the wet web facing surface of said wet web side layer is hydrophilic, and in which at least a part of the interior surfaces of said water holding section are hydrophobic.

11. A shoe press of a papermaking machine according to claim 10, in which the magnitude of the hydrophobic property of each said hydrophobic part of the interior surfaces of said water holding section is such that the contact angle between the edge of a drop of water and each said hydrophobic part of the interior surfaces of said water holding section is at least 50°.

* * * * *